US010710108B2

(12) United States Patent
Schwab et al.

(10) Patent No.: US 10,710,108 B2
(45) Date of Patent: Jul. 14, 2020

(54) COATING SYSTEM AND METHOD FOR COATING OBJECTS

(71) Applicant: EISENMANN SE, Boeblingen (DE)

(72) Inventors: Stephan Schwab, Waldenbuch (DE); Tobias Mozer, Leinfelden-Echterdingen (DE)

(73) Assignee: EISENMANN SE, Böblingen (DE)

( * ) Notice: Subject to any disclaimer, the term of this patent is extended or adjusted under 35 U.S.C. 154(b) by 0 days.

(21) Appl. No.: 15/301,327

(22) PCT Filed: Mar. 31, 2015

(86) PCT No.: PCT/EP2015/000690
§ 371 (c)(1),
(2) Date: Nov. 18, 2016

(87) PCT Pub. No.: WO2015/149936
PCT Pub. Date: Oct. 8, 2015

(65) Prior Publication Data

US 2017/0066000 A1 Mar. 9, 2017

(30) Foreign Application Priority Data

Apr. 1, 2014 (DE) ..... 10 2014 004 718

(51) Int. Cl.
*B05B 12/14* (2006.01)
*B05B 12/02* (2006.01)
(Continued)

(52) U.S. Cl.
CPC ..... *B05B 12/1481* (2013.01); *B05B 12/02* (2013.01); *B05B 12/08* (2013.01);
(Continued)

(58) Field of Classification Search
USPC ..... 118/300, 712, 713, 684, 692, 665, 679; 427/427, 427.1
See application file for complete search history.

(56) References Cited

U.S. PATENT DOCUMENTS 5,014,645 A 5/1991 Cann et al.
5,193,572 A * 3/1993 Le Devehat ..... F16L 55/46 137/244
(Continued)

FOREIGN PATENT DOCUMENTS

CA 2 346 419 A1 2/2001
DE 33 45 125 A1 6/1985
(Continued)

*Primary Examiner* — Yewebdar T Tadesse
(74) *Attorney, Agent, or Firm* — Schroeder Intellectual Property Law Group, LLC

(57) ABSTRACT

A coating system for coating objects with a coating material includes at least one material source for a coating material, which can be fluidically connected to an application device. A feed system can be used for feeding coating material back to its material source in a feeding-back direction over a feed path. It can be determined by means of a detection device whether coating material or some other material is present in a control portion of the feed path, the detection device generating a corresponding output signal. Also specified is a method for coating objects in which it is determined during the feeding back of coating material to its material source whether regions made up of material other than the coating material are being carried along by the coating material to be fed back.

18 Claims, 7 Drawing Sheets

(51) Int. Cl.

| | |
|---|---|
| ***B05B 12/08*** | (2006.01) |
| ***B05B 15/58*** | (2018.01) |
| ***B05B 14/00*** | (2018.01) |
| ***B05D 1/02*** | (2006.01) |

(52) U.S. Cl.
CPC ..... *B05B 14/00* (2018.02); *B05B 15/58* (2018.02); *B05D 1/02* (2013.01)

(56) References Cited

U.S. PATENT DOCUMENTS

| | | | | |
|---|---|---|---|---|
| 5,882,408 | A * | 3/1999 | Fujita | B05C 5/004 118/410 |
| 6,077,354 | A | 6/2000 | Kaneski et al. | |
| 6,582,774 | B2 * | 6/2003 | Klein | B05B 9/035 427/421.1 |
| 7,110,123 | B2 | 9/2006 | Baumann et al. | |
| 7,584,771 | B2 | 9/2009 | Herre et al. | |
| 2004/0075848 | A1 | 4/2004 | Baumann et al. | |
| 2004/0226391 | A1 * | 11/2004 | Ucan | B05B 12/1481 73/865.9 |
| 2006/0086407 | A1 | 4/2006 | Herre et al. | |
| 2009/0134241 | A1 | 5/2009 | Hoffmann | |
| 2012/0037716 | A1 | 2/2012 | Heldt et al. | |
| 2012/0315381 | A1 * | 12/2012 | Mergner | F01N 3/2828 427/8 |

FOREIGN PATENT DOCUMENTS

| | | | |
|---|---|---|---|
| DE | 43 42 128 | A1 | 6/1995 |
| DE | 199 37 474 | A1 | 3/2001 |
| DE | 101 20 077 | A1 | 11/2002 |
| DE | 101 61 550 | A1 | 6/2003 |
| DE | 103 33 547 | A1 | 2/2005 |
| DE | 603 02 702 | T2 | 10/2006 |
| DE | 20 2014 002 818 | U1 | 6/2014 |
| EP | 0 387 977 | A2 | 9/1990 |
| EP | 1 500 435 | A2 | 1/2005 |
| EP | 2 065 101 | A1 | 6/2009 |
| JP | H11-253846 | A | 9/1999 |
| WO | 03/095106 | A2 | 11/2003 |

* cited by examiner

COATING SYSTEM AND METHOD FOR COATING OBJECTS

RELATED APPLICATIONS

This application is a national phase of International Patent Application No. PCT/EP2015/000690, filed Mar. 31, 2015, which claims the filing benefit of German Patent Application No. 10 2014 004 718.0 filed Apr. 1, 2014, the contents of both of which are incorporated herein by reference.

FIELD OF THE INVENTION

The invention relates to a coating system for coating objects with a coating material, comprising a) at least one material source for a coating material, which can be fluidically connected to an application device, and b) a feed system, with which coating material can be fed back to its material source in a feeding-back direction over a feed path.

The invention also relates to a method for coating objects, in which a) an object is coated with a coating material with the help of an application device;

b) the application device is supplied with the coating material from a material source;

c) upon completion of the application process coating material is fed back in a feeding-back direction into its material source.

BACKGROUND OF THE INVENTION

In coating systems of the abovementioned type known from the market, the application device, which in painting processes may involve, for example a high-speed rotating atomizer, is supplied with a coating material, which is applied to the object to be coated.

Apart from paints, other coating materials can also be applied using various application devices, for example preservatives such as wax, individual components of multi-component adhesives, or possibly even high viscosity substances such as sealing materials.

By way of example, in the case of a painting system a coating material change device, that is to say, therefore, a colour changer, is used, if in normal operation it frequently occurs that for the coating of an object another paint has to be used that differs from that with which a previous object was painted.

In the event of a colour change the channels and lines carrying the material must have the previously used paint cleaned out from them, to which end a flushing agent is passed through the corresponding channels and lines. In order to keep the paint losses and quantities of flushing agent required as low as possible, what is known as the pigging technique is often used in which the coating materials or flushing agent are pushed through the channels and lines with the help of pigs. In doing so the pig is moved back and forth between two pigging stations, one of which is disposed in the vicinity of the application device and the other in the vicinity of the change device.

It has become established, in particular, that coating material that has not been applied, and which remains in the lines to the application device, is fed back into its material source, in order to minimise the paint losses.

Here, however, it is of major importance that no foreign materials reach the material source. In the present case air is also understood to be such a foreign material. Known colour changers are supplied by what are known as ring circuits. In this case in particular air bubbles must be prevented from entering a ring circuit since otherwise proper metering-in of specified quantities of material from this ring circuit is hampered.

SUMMARY OF THE INVENTION

An object of the invention, therefore, is to create a coating system and a method of the abovementioned type which take into account these considerations.

This object may be achieved by a coating system of the abovementioned type, in that c) a detection device is present, by means of which it can be determined whether coating material or some other material is present in a control portion of the feed path, and which generates a corresponding output signal.

The invention is based, inter alia, on the knowledge that it is sufficient to be able to distinguish between coating material and "non-coating material", in order to take appropriate countermeasures by which contamination of the material source by other materials, in particular air, can be prevented. As will become clear in the following, at the time of detection a distinction does not have to be made between the presence of air or a pig in the coating material. Here the control portion defines the region of the feed path, in which the feed material present is to be checked.

It is above all convenient, if from the feed path in the feeding-back direction before the material source a discharge line branches off, which can be opened or closed by means of a valve, and the feed path in the feeding-back direction after the discharge line can be opened or closed by means of a valve. Via the discharge line the volume of material to be fed back can be drained off before the material source, if a deviating material has been detected. As a rule, the region with the deviating material and the volume following in the feeding-back direction are purged from the coating material via the discharge line.

The control portion of the feed path in the feeding-back direction is preferably disposed before the discharge line.

A control device is preferably present, which communicates with the detection device and is configured in such a way that it blocks the flow path in the direction of the material source, if a material deviating from the coating material is detected. In this way it is in the first instance ensured that no further material is fed into the material source.

It is also convenient if the control device is configured in such a way that it blocks the flow path in the direction of the material source if the material deviating from the coating material reaches the discharge line. Normally, for structural reasons, a stretch must remain between the control portion and the discharge line, so that coating material not presenting a problem which is present in this stretch can be fed further in the direction of the material source, until the deviating material reaches the discharge line.

It is convenient for the process if the control device is configured in such a way that it depressurises the feed path following blocking and then again develops a feed pressure. This in the first instance allows an analysis of whether an air bubble or similar is involved.

For this a pressure sensor is particularly advantageous, by means of which the pressure in the feed path can be measured, which substantially corresponds to the pressure at the branching to the discharge line. Depending on whether or not an increase in pressure is recorded, it can for example be inferred if an air bubble or a pig has been detected. This is dealt with in more detail below.

It is an advantage if the feed system comprises a pig, via which coating material can be fed at least over part of the feed path between a first pigging station and a second pigging station.

The detection device preferably comprises an ultrasound sensor or an optical sensor. In the latter case, if necessary, the type of material detected can be determined more specifically.

The abovementioned object may be achieved by a method of the type initially referred to in that d) when feeding back it is determined whether the coating material to be fed back is carrying with it regions from the material deviating from the coating material.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

In the following embodiments of the invention are explained in more detail using the drawings. These show as follows.

DETAILED DESCRIPTION OF THE PRESENT INVENTION

Figure 1:
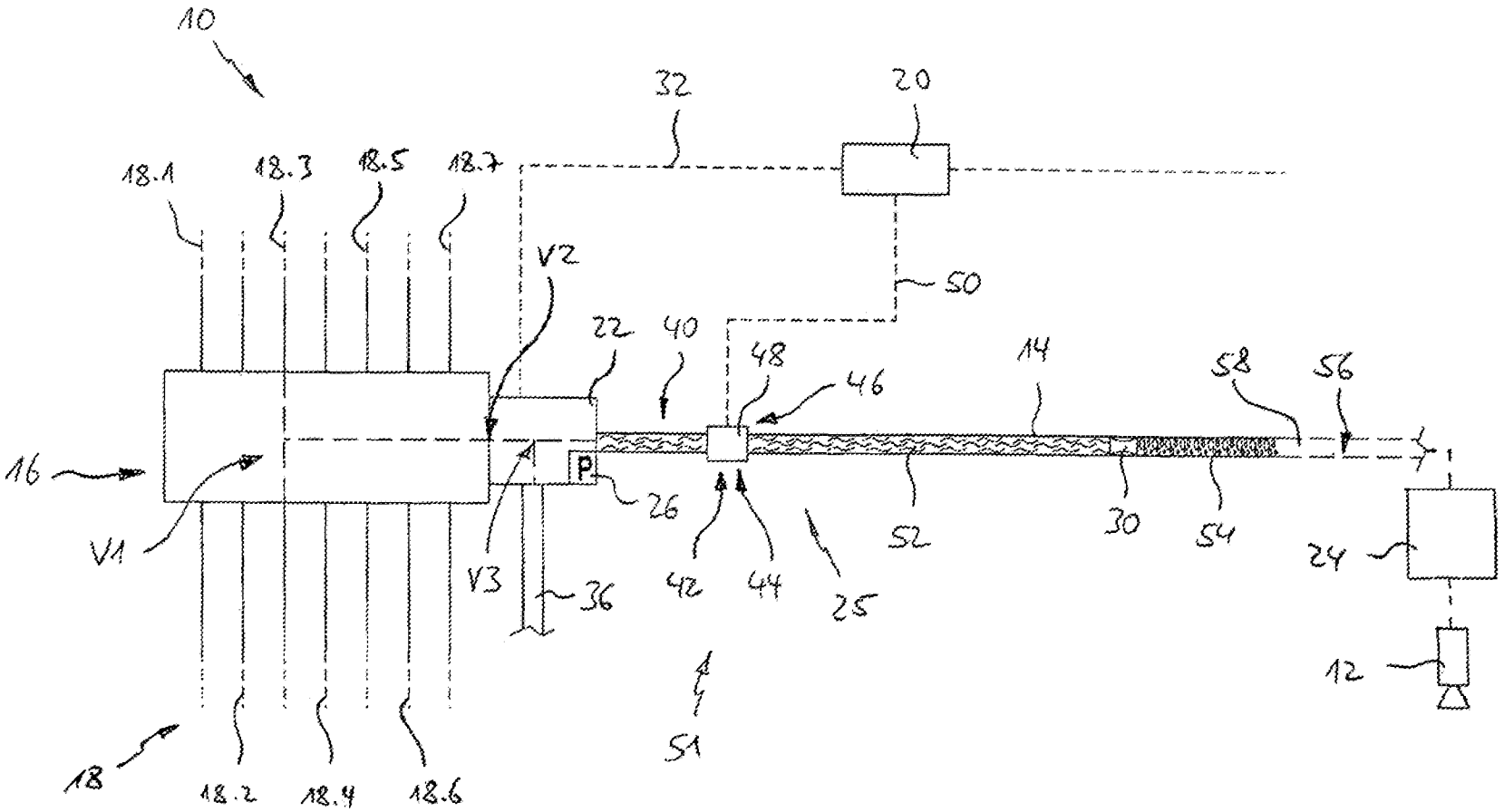
FIG. 1 a schematic view of the layout of a coating system according to a first embodiment, which is connected to a coating material change device, connected with a piggable line, and comprises a detection device, by means of which a control portion of the piggable line can be monitored at least for a material change within this control portion, wherein the colour change system is in a back-pressure mode, in which a coating material with the help of a pig is pushed out of the piggable line back into the change device.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference is made in the first instance to FIG. 1. There a coating system 10 for application of a coating material according to a first embodiment is shown in full, comprising an application device 12, which for simplicity is shown only in FIG. 1. In this case, by way of example, a coating system 10 for paint is described. In this case the application device 12 can for example be a spray gun or a high-speed rotating atomiser, which is and of itself known.

The application device 12 is connected via a line 14 with a supply device shown only schematically, which in the present embodiment takes the form of a change device 16 for coating materials and for its part is supplied by a number of material sources 18, as is known in and of itself. In the present embodiment there are seven ring circuits 18.1 to 18.7, but there can also be less or also considerably more such ring circuits present, which can number as many as 50 or more. The materials provided by the ring circuits 18.1 to 18.7 can, apart from different coating materials, in particular paints, also be compressed air and flushing agent. In the case of the application of paints the change device 16 is thus a colour change device.

The change device 16 comprises in the usual way a valve device identified in its entirety as V1 with a plurality of valves, controllable via a control device 20, so that the line 16 can optionally be fluidically connected to one of the ring circuits 18.1 to 18.7 present. The way such change devices work is sufficiently well known for it to be of no further interest here.

The coating system 2 is likewise operated in an in and of itself known manner using the pigging technique. Therefore, between the change device 16 and the line 14 a first pigging station 22 is disposed, while in the vicinity of the application device 12 in the line 14 a second pigging station 24 is present. The first pigging station 22 is hereinafter referred to as the starting pigging station and the second pigging station 24 as the target pigging station with the reference numerals being retained. For simplicity, the target pigging station 24 is also shown only in FIG. 1 and then in highly schematic form; feed lines to the target pigging station 24 present for compressed air and flushing agent and branches are not shown. Together, the line 14, the change device 16, the start pigging station 22 and the target pigging station 24, constitute a feed path 25, via which the change device 16 is fluidically connected to the application device 12.

The flow connection between the start pigging station 22 and the change device 16 can be opened or closed by means of a valve V2. In the start pigging station 22 at the change device 16 a pressure sensor 26 identified by P is present, by means of which the line pressure at the parking position 28 of a pig 30 in the start pigging station 22 is monitored. The output signal of the pressure sensor 26 is transmitted via a cable or radio connection 32 to the control device 20. Generally speaking, with the pressure sensor 26 a pressure in the feed path 25 is determined, which substantially corresponds to the pressure at the branch to the discharge line 36.

Figures 3, 3A, 3B:
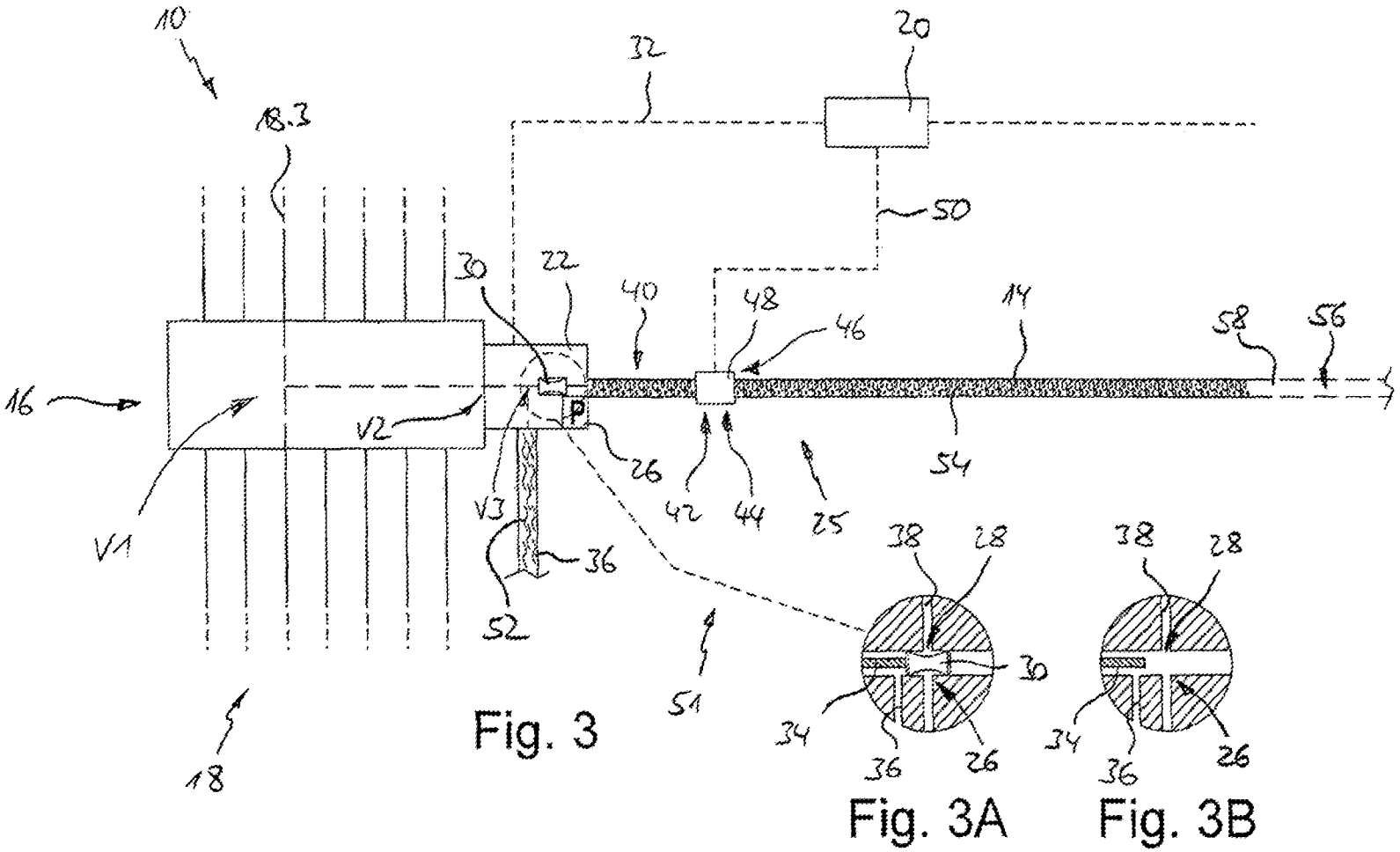
FIG. 3 the colour change system, wherein the pig is in a pigging station at the change device.
FIG. 3A a detailed view of the pigging station with the pig located therein.
FIG. 3B a detailed view corresponding to FIG. 3A of the pigging station without pig.

The parking position 28 is shown in FIGS. 3A and 3B; in this parking position 28 the pig 30 comes up against a mooring element 34, which prevents a further movement of the pig 30 in the direction of the change device 16. Between the parking position 28 and the change device 16 a discharge line runs from the start pigging station 22 which in the following is referred to in the normal way as a dump line 36 and can be opened or closed by means of a valve V3.

In the parking position 28 the edges of the pig 30 are flushed, for which purpose the start pigging station 22 has a flushing agent channel 38, which intersects the parking position 28. This is shown in FIGS. 3A and 3B. If flushing agent flows through the flushing line 38 and the pig 30 is in the parking position 26, the flushing agent flushes the edges of this. The target pigging station 24 shown only schematically has a structure which matches that of the start pigging station 22, wherein a corresponding dump line in the direction of the application device 12 branches off behind the parking position for the pig 30.

A control portion 42 of the feed path 25 runs at a distance 40 from the start pigging station 22, in this specific case the line 14, through a sensor area 44 of a detection device 46, which in the sensor area 44 can at least detect if coating material or a material deviating from this is present in the control portion 42. Such a detection device 46 can for example be designed as an ultrasound sensor. The output signal of the ultrasound sensor 48 is transmitted via a cable or radio connection 50 to a control device, which in the present embodiment is similarly the control device 20.

As explained above, in the event of a change in the coating material the coating material still in the line 14 is pushed back via the change device 16 into the associated ring circuit 18, so that as little as possible of the coating material is lost. Generally speaking, the pig 30 and the components required for the pigging technique thus form a feed system 51, by means of which coating material can be fed back via the feed path 25 in a feeding-back direction into its material source 18. Here the feeding-back direction defines the direction in the feed path 25 to the material source 18. In the embodiment described here the feed path 25 is used both for the feeding of coating material to the application device 12 and for the feeding of coating material back into one of the ring circuits 18.1 to 18.7. If necessary, however, there may be feed paths for the two feed directions that are separate or at least only partially overlap.

The pushing back of coating material in the coating system 12 is now explained using FIGS. 1 to 6:

The starting situation is considered to be that an application process with a particular coating material 52, in this case a paint material, from the ring circuit 18.3, has been completed. During application the pig 30 was detected in the second pigging station 24 at the application device 12. In the first instance, reference is now made to FIGS. 1 to 3, showing a pushing back process, in which no air bubbles appear in the paint material 52 in the line 14.

FIG. 1 shows a phase in which the pig 30 is positioned in the line 14 on its way to the first pigging station 22, wherein it shifts paint material 52 before it in the direction of the change device 16. In the direction of movement behind the pig 30 there is a flushing agent 54 in the line 14, against which a thrust medium 56 in the form of compressed air 58 pushes from the direction of the second pigging station 24. The compressed air 58 pushes the flushing agent 54, the pig 30 and the paint material 52 with a pressure of for example approximately 20 bar to the change device 16.

The dump line 36 at the first pigging station 22 is closed by the valve V3 and the flow path through the change device 16 to the ring circuit 18.3 is opened by the valve V2, so that paint material 42 is pushed back into the ring circuit 18.3.

Figure 2:
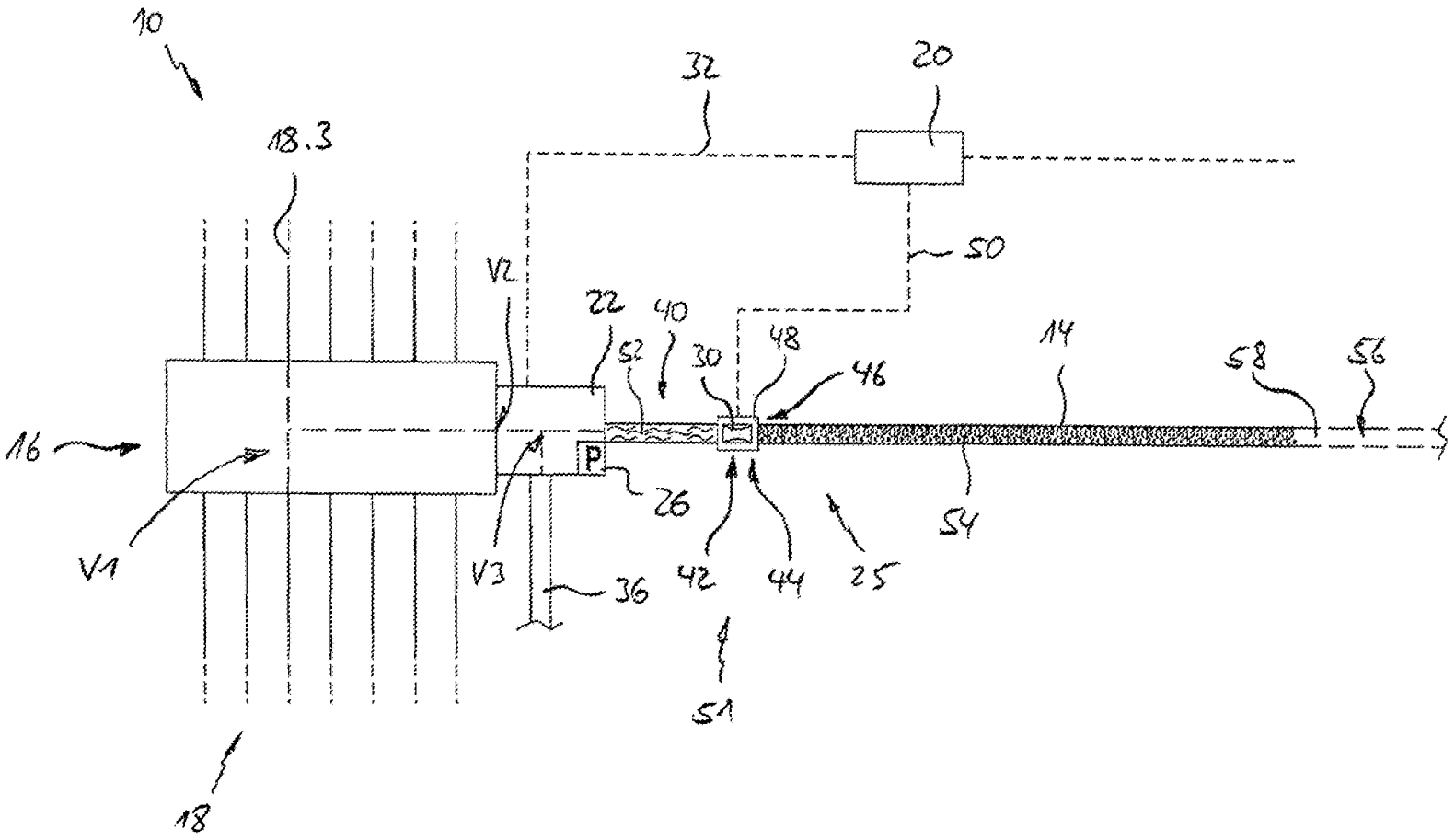
FIG. 2 the coating system from FIG. 1, wherein the pig is located in the control portion.

If now, as shown in FIG. 2, the pig 30 reaches the sensor area 44 of the control portion 42 of the line 14, the sensor response of the ultrasound sensor 48 changes and the output signal of the detection device 46 indicates that a material deviating from the coating material has been detected. In this way the control device 20 records that now there is no longer any liquid material there.

In this case the control device 20 in the first instance determines that the flow path in the change device 16 to the ring circuit 18.3 is closed and the flow path in the discharge line 30 remains closed, to which end the valves V2 and V3 responsible for this are operated accordingly.

The operation of valves V2, V3 is timed to match the flow speed in the line 14 and takes place if the sensor-triggering component has reached the discharge line 36. This is the case here if the sensor-triggering component has reached the parking position 28 in the start pigging station 22. The longitudinal extension of the sensor-triggering component and thus the volume in line 14 can be ascertained by correlating the duration of the corresponding sensor response to the flow speed. The flow of each different paint is known and can vary in each case, wherein it is of the order of 2 m/s.

If necessary, the sensor area 44 can also be displaceable along line 14, so that the distance 40 between the start pigging station 22 and the sensor area 44 can be adjusted. In this way the system can be matched to various coating materials with different rheological characteristics.

In this case, therefore, the pig 30 is the sensor-triggering component and ensures the sensor response of the ultrasound sensor 48. The valves V2, V3 are accordingly switched at the moment when the pig 30 reaches its parking position 28 in the start pigging station 22, as shown in FIG. 3 in conjunction with FIG. 3A.

Then the system is in the first instance depressurised in that the line 14 is vented via a bleed valve at the target pigging station 24. Then the control device 20 ensures that by means of compressed air from the direction of the target pigging station 24 a feed pressure is again developed in line 14.

Since the pig 30, however, as shown in FIG. 3A, is now in its parking position 28 in the start pigging station 22 against its mooring element 34, this blocks the flow path and the pressure at the parking position 28 does not increase. This is detected by the pressure sensor 26 or by the control device 20 and converted into information, that the pig 30 is in its parking position. In this case the paint material 52 is fed back as far as possible into the ring circuit 18.3 and a colour change can be initiated.

Figure 4:
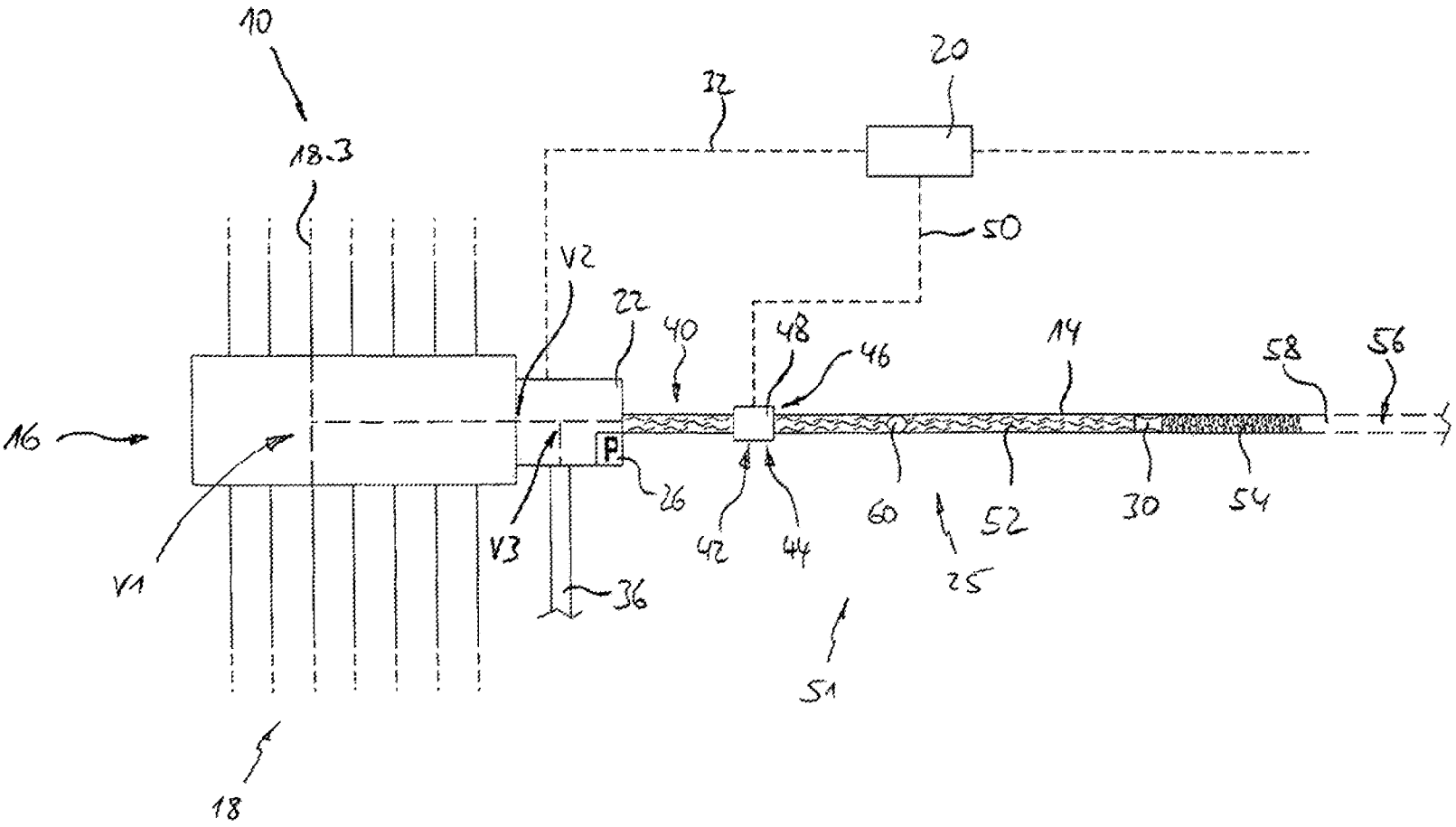
FIG. 4 the coating system with an air bubble in the coating material.
Figure 5:
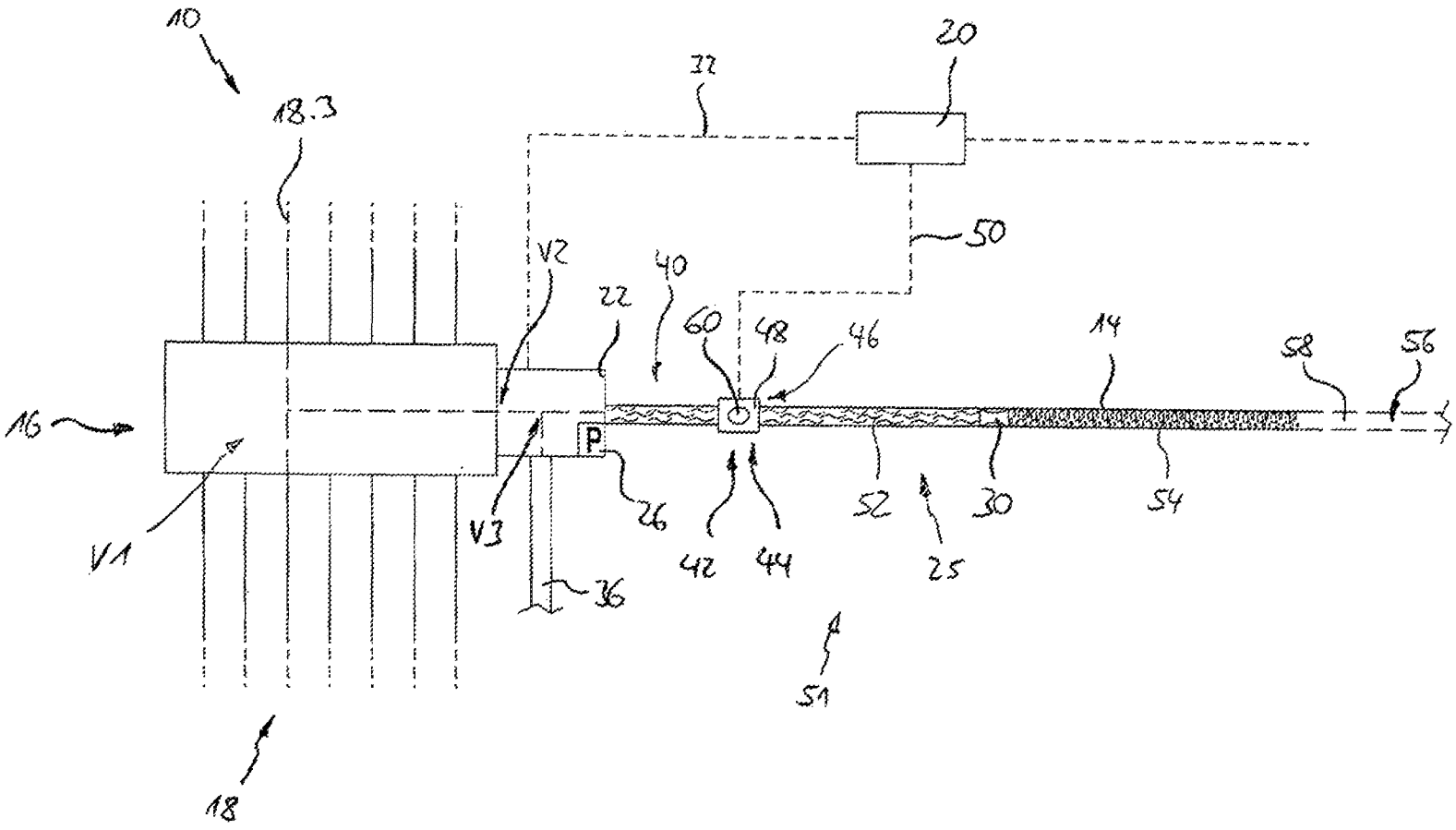
FIG. 5 the colour change system, wherein the air bubble has reached as far as the control portion.
Figure 6:
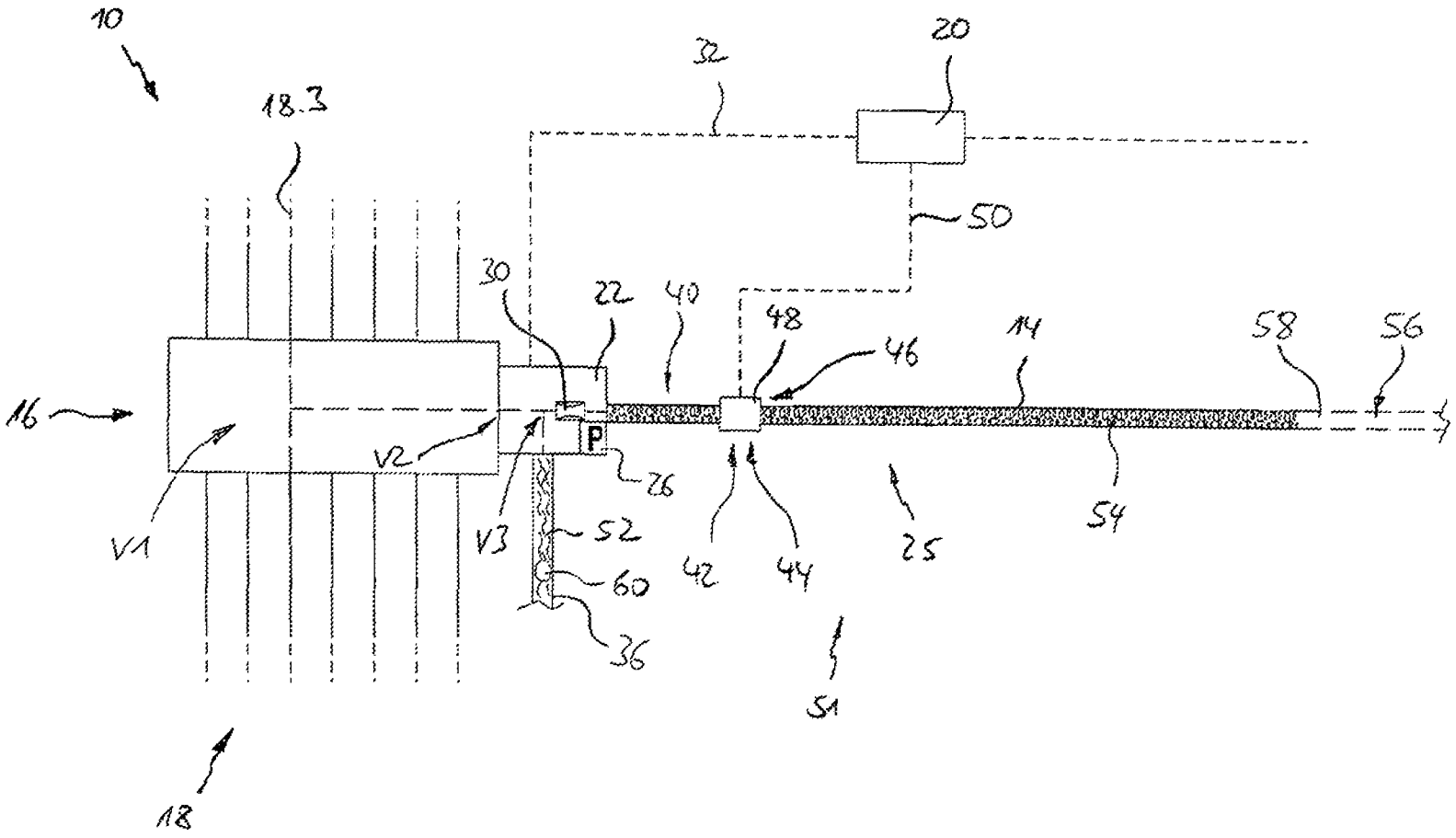
FIG. 6 the coating system, in which the coating material, comprising the air bubble, is eliminated from the system via a discharge line.

FIGS. 4 to 6 now show the process if in the paint material 52 an air bubble 60 is being carried and fed together with the paint material 52 in the direction of the change device 16, wherein the flow path in the change device 16 is open and in the dump line 36 closed. The air bubble 60 describes for example a region of material deviating from the coating material 52, which is being carried along by the coating material 52 to be fed back.

In FIG. 4 the air bubble 60 is still in the movement direction in front of the sensor area 44. If the air bubble 60, as shown in FIG. 5, then reaches the sensor area 44, the output signal of the ultrasound sensor 48 changes again and the control device 20 records that there is no longer any liquid material there. The sensor-triggering component is in this case, therefore, the air bubble 60.

In this case also, the control device 20 determines that the flow path in the change device 16 to the ring circuit 18.3 is closed and the flow path in the dump line 36 remains closed. To this end the valves V2 and V3 responsible for this are operated accordingly, if the air bubble 600 as the sensor-triggering component has reached the start pigging station.

The line 14 is in turn initially vented in the manner described above and thereby depressurised. The control device 20 then ensures that by means of compressed air from the direction of the target pigging station 24 a feed pressure is again developed on the flushing agent 54 in the line 14.

The pig 30, however, has not yet reached its parking position in the start pigging station, but is pushing in the line 14 against the material in the direction of the start pigging station 22. Since the pig 30 is therefore not blocking any flow of paint material 52, the pressure at the parking position 28 in the start pigging station 22 now increases. This is detected by the pressure sensor 26 or by the control device 20 and converted into the information that there is no pig 30 in the parking position.

In this case the control device 20 causes the dump line 36 to be opened via the valve V3, so that the paint material 52 containing the air bubble 60 is removed via the dump line 36 from the system.

If now the pig 30 reaches the sensor area 44, a corresponding process takes place as explained above regarding FIGS. 1 to 3, wherein in the first instance the dump line 36 is closed and the flow path in the change device 16 remains closed, if the pig 30 as the sensor-triggering component reaches the parking position 28 in the start pigging station 22.

Upon renewed pressurisation the control device 20 accordingly again detects from the unvarying pressure at the parking position 28 of the start pigging station 22, that the pig 44 was the sensor-triggering component and the back-pressure process is complete As an alternative to the ultrasound sensor 48, if necessary optical sensor systems can also be considered. For example, light can be fed from a light source through an entry window into the lateral surface of the line 14 in the control portion 42 and emerging or reflected radiation is evaluated with the help of a detector unit. If emerging radiation is to be detected, in the control portion 42 of the line 14 opposite the entry window a corresponding exit window for radiation is provided in the lateral surface. Depending on the radiation detected, if necessary then it can even be specifically ascertained if paint, flushing agent, a pig, or an air bubble, is located in the control portion 42 in the sensor area 44.

Figure 7:
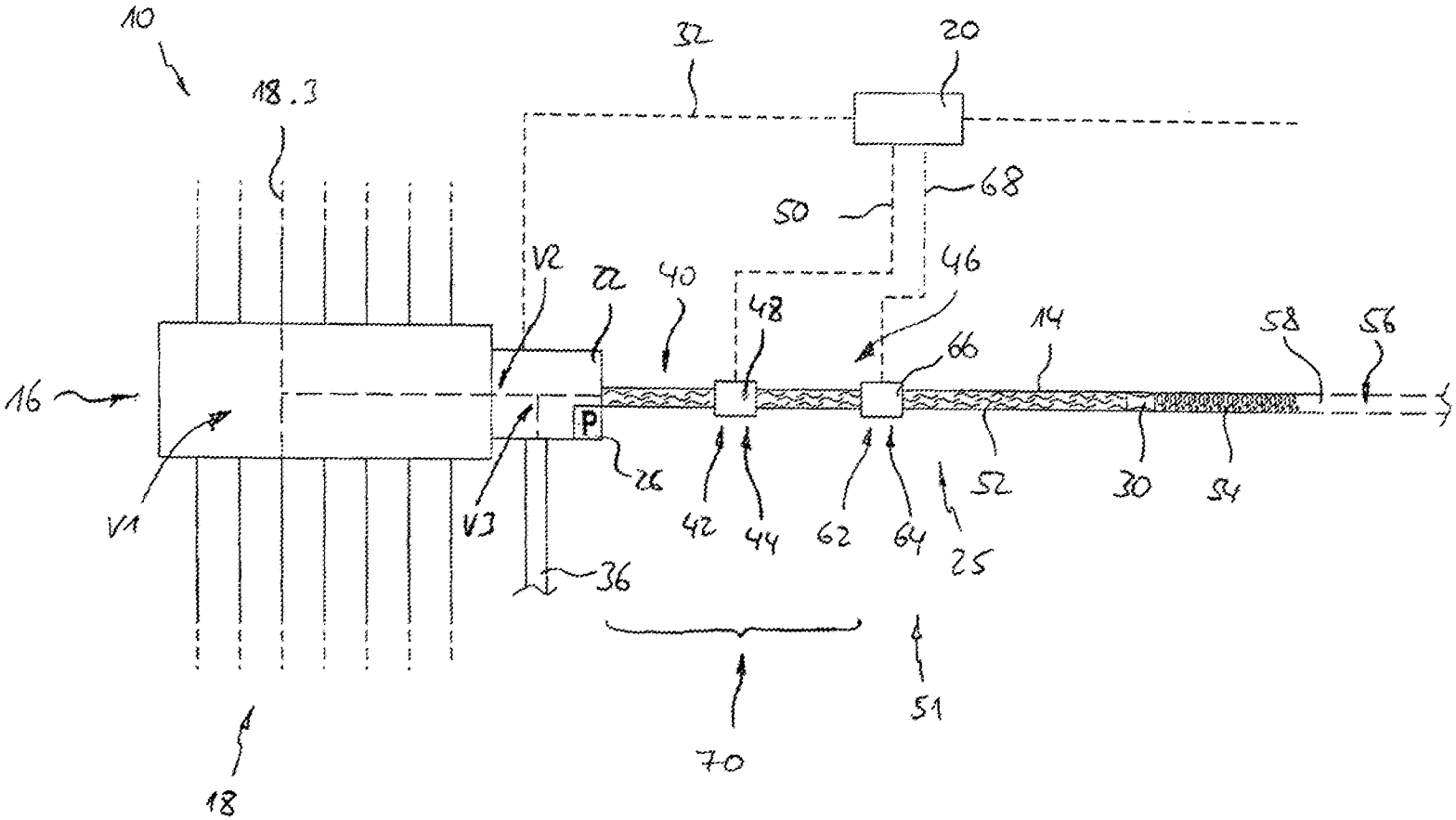
FIG. 7 a schematic view of the layout of a coating system according to a second embodiment, comprising a second sensor.

FIG. 7 shows as a second embodiment a modified coating system 10, in which the only difference is that the detection device 46 next to the sensor area 44 comprises a second sensor area 62, through which a second control portion 64 of the line 14 runs, which for its part in this embodiment is monitored with the help of a second ultrasound sensor 66, which transmits its output signal via a cable or radio connection 68 to the control device 20. The second sensor area 62 is a distance 70 away from the start pigging station 22, which differs from the distance 40 in relation to the now first sensor area 44.

Depending on the type and characteristics of the paint material 52 in the line 14 one or the other sensor area 44 or 62 can be used for monitoring the back-pressure process.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

What is claimed is:

1. A coating system for coating objects with a coating material, comprising:

a) at least one material source for a coating material, which is fluidically connected to an application device, and b) a feed system having a feed path, with which the coating material is provided from the at least one material source to the application device and fed back to the at least one material source for the coating material from the application device in a feed-back direction over the feed path when application is complete, wherein the coating material enters the feed path from the material source and is pushed towards the application device, and is fed back from the application device to the material source without leaving the feed path and the coating material which has been fed back along the feed path re-enters the at least one material source when exiting the feed path, c) a detection device, the detection device determining whether the coating material or some other material is present in a control portion of the feed path, and which generates a corresponding output signal.

2. The coating system according to claim 1, wherein from the feed path in the feed-back direction before the material source, a discharge line branches off, which is opened or closed by means of a valve, and the feed path in the feed-back direction after the discharge line is opened or closed by means of a valve.

3. The coating system according to claim 2, wherein the control portion of the feed path in the feed-back direction is disposed before the discharge line.

4. The coating system according to claim 3, wherein a control device is present, the control device being in communication with the detection device and being configured in such a way that the control device blocks the flow path in the direction of the at least one material source, if a material deviating from the coating material is detected.

5. The coating system according to claim 4, wherein the control device is configured in such a way that the control system blocks the flow path in the direction of the at least one material source if the material deviating from the coating material reaches the discharge line.

6. The coating system according to claim 4, wherein the control device is configured in such a way that the control device depressurises the feed path following blocking and then again develops a feed pressure.

7. The coating system according to claim 6, wherein the feed system comprises a pig via which coating material can be fed at least over part of the feed path between a first pigging station and a second pigging station.

8. The coating system according to claim 7, further comprising a pressure sensor which measures the pressure in the feed path, the pressure sensor being located at the second pigging station.

9. The coating system according to claim 8, wherein the feed pressure is blocked from the pressure sensor by the pig when the pig is parked against a mooring element in the second pigging station.

10. The coating system according to claim 9, wherein a color change can be initiated if the pressure sensor does not measure the feed pressure as a result of the pig being parked against the mooring element, when the feed path is repressurized by the control device.

11. The coating system according to claim 4, wherein a pressure sensor is present, by means of which the pressure in the feed path is measured, which substantially corresponds to the pressure at the branching to the discharge line.

12. The coating system according to claim 1, wherein the feed system comprises a pig, via which coating material is fed at least over part of the feed path between a first pigging station and a second pigging station.

13. The coating system according to claim 1, wherein the detection device comprises an ultrasound sensor or an optical sensor.

14. The coating system according to claim 1, wherein a control device is present, the control device communicating with the detection device and being configured in such a way that the control device blocks the flow path in the direction of the at least one material source, if a material deviating from the coating material is detected.

15. The coating system according to claim 1, wherein the feed path comprises a change device connected to the at least one ring line, a first pig station connected to the change device, a line connected to the first pig station at a first end and connected to an application device at a second end, wherein the coating material moves from the material source to the at least one ring line through the change device, the first pig station, and the line to the application device in a feed direction, and through the line, the first pig station, and the change device back to the at least one ring line and re-enters the material source in a feedback direction.

16. The coating system according to claim 15, further comprising a discharge line, the discharge line being positioned between the application device and the change device and being controllable by a first valve, wherein a second valve is positioned downstream from first valve in the feedback direction, the second valve opening and closing the feed path.

17. The coating system of claim 16, further comprising a pressure sensor located in the first pig station for detecting the pressure of coating material as it is retuned from the application device through the line, the first pig station, and the change device, and a control device, the control device being in communication with the pressure sensor, the detection device, the first valve, and the second valve, wherein the control device opens and closes the first valve and the second valve in response to the pressure sensor and the detection device when coating material is moved in the feedback direction.

18. The coating system of claim 15 wherein the detection device is an ultrasound sensor.

* * * * *